US005963901A

United States Patent [19]

Vähätalo et al.

[11] Patent Number: 5,963,901

[45] Date of Patent: Oct. 5, 1999

[54] METHOD AND DEVICE FOR VOICE ACTIVITY DETECTION AND A COMMUNICATION DEVICE

[75] Inventors: Antti Vähätalo; Juha Häkkinen; Erkki Paajanen, all of Tampere, Finland

[73] Assignee: Nokia Mobile Phones Ltd., Salo, Finland

[21] Appl. No.: 08/763,975

[22] Filed: Dec. 10, 1996

[30] Foreign Application Priority Data

Dec. 12, 1995 [FI] Finland ..... 955947

[51] Int. Cl.[6] ..... G10L 9/00

[52] U.S. Cl. ..... 704/233; 704/218; 704/219; 704/227

[58] Field of Search ..... 704/218, 233, 704/219, 227, 210, 215

[56] References Cited

U.S. PATENT DOCUMENTS

| | | | |
|---|---|---|---|
| 4,401,849 | 8/1983 | Ichikawa et al. | 704/215 |
| 5,276,765 | 1/1994 | Freeman et al. | 395/2 |
| 5,285,165 | 2/1994 | Renfors et al. | 704/226 |
| 5,410,632 | 4/1995 | Hong et al. | 704/233 |
| 5,446,757 | 8/1995 | Chang | 375/239 |
| 5,457,769 | 10/1995 | Valley | 704/210 |
| 5,459,814 | 10/1995 | Gupta et al. | 704/233 |
| 5,550,893 | 8/1996 | Heidari | 379/59 |
| 5,649,055 | 7/1997 | Gupta | 704/233 |
| 5,659,622 | 8/1997 | Ashley | 704/227 |
| 5,668,927 | 9/1997 | Chan et al. | 704/240 |
| 5,689,615 | 11/1997 | Benyassine et al. | 704/210 |
| 5,706,394 | 1/1998 | Wynn | 704/219 |
| 5,708,754 | 1/1998 | Wynn | 704/219 |
| 5,749,067 | 5/1998 | Barrett | 704/215 |

FOREIGN PATENT DOCUMENTS

| | | |
|---|---|---|
| 0222083 A1 | 5/1987 | European Pat. Off. . |
| WO 95/08170 | 3/1995 | WIPO . |

*Primary Examiner*—David R. Hudspeth
*Assistant Examiner*—Daniel Abebe
*Attorney, Agent, or Firm*—Perman & Green, LLP

[57] ABSTRACT

The invention concerns a voice activity detection device in which an input speech signal (x(n)) is divided in subsignals (S(s)) representing specific frequency bands and noise (N(s)) is estimated in the subsignals. On basis of the estimated noise in the subsignals, subdecision signals (SNR(s)) are generated and a voice activity decision ($V_{ind}$) for the input speech signal is formed on basis of the subdecision signals. Spectrum components of the input speech signal and a noise estimate are calculated and compared. More specifically a signal-to-noise ratio is calculated for each subsignal and each signal-to-noise ratio represents a subdecision signal (SNR(s)). From the signal-to-noise ratios a value proportional to their sum is calculated and compared with a threshold value and a voice activity decision signal ($V_{ind}$) for the input speech signal is formed on basis of the comparison.

10 Claims, 11 Drawing Sheets

SNR ( s )
110
111
Spectrum distance
$D_{SNR}$
112
Comparison of $D_{SNR}$ and vth
vth
113
Adoptation of treshold value
$\hat{N}$
η
$V_{ind}$ 1
A/D
X ( n )
7
LTP analysis and voiced detection
voiced
100
Noise estimate update control
$ST_{count}$
80
Noise estimate
6
Calculate spectrum components
S ( s )
70
Relative noise
N ( s )
90
SNR calculation
SNR ( s )
VAD desicision
110
$V_{ind}$ 80
83
$N_{n-1}(s)$
81
$N_n(s)$
82
$\lambda(s)$
$N(s)$
$S(s)$
$ST_{count}$
$V_{ind}$

METHOD AND DEVICE FOR VOICE ACTIVITY DETECTION AND A COMMUNICATION DEVICE

FIELD OF THE INVENTION

This invention relates to a voice activity detection device comprising means for detecting voice activity in an input signal, and for making a voice activity decision on basis of the detection. Likewise the invention relates to a method for detecting voice activity and to a communication device including voice activity detection means.

BACKGROUND OF THE INVENTION

A Voice Activity Detector (VAD) determines whether an input signal contains speech or background noise. A typical application for a VAD is in wireless communication systems, in which the voice activity detection can be used for controlling a discontinuous transmission system, where transmission is inhibited when speech is not detected. A VAD can also be used in e.g. echo cancellation and noise cancellation.

Various methods for voice activity detection are known in prior art. The main problem is to reliably detect speech from background noise in noisy environments. Patent publication U.S. Pat. No. 5,459,814 presents a method for voice activity detection in which an average signal level and zero crossings are calculated for the speech signal. The solution achieves a method which is computationally simple, but which has the drawback that the detection result is not very reliable. Patent publications WO 95/08170 and U.S. Pat. No. 5,276,765 present a voice activity detection method in which a spectral difference between the speech signal and a noise estimate is calculated using LPC (Liner Prediction Coding) parameters. These publications also present an auxiliary VAD detector which controls updating of the noise estimate. The VAD methods of all the above mentioned publications have problems to reliably detect speech when speech power is low compared to noise power.

SUMMARY OF THE INVENTION

The present invention concerns a voice activity detection device in which an input speech signal is divided in subsignals representing specific frequency bands and voice activity is detected in the subsignals. On basis of the detection of the subsignals, subdecision signals are generated and a voice activity decision for the input speech signal is formed on basis of the subdecision signals. In the invention spectrum components of the input speech signal and a noise estimate are calculated and compared. More specifically a signal-to-noise ratio is calculated for each subsignal and each signal-to-noise ratio represents a subdecision signal. From the signal-to-noise ratios a value proportional to their sum is calculated and compared with a threshold value and a voice activity decision signal for the input speech signal is formed on basis of the comparison.

For obtaining the signal-to-noise ratios for each subsignal a noise estimate is calculated for each subfrequency band (i.e. for each subsignal). This means that noise can be estimated more accurately and the noise estimate can also be updated separately for each subfrequency band. A more accurate noise estimate will lead to a more accurate and reliable voice activity detection decision. Noise estimate accuracy is also improved by using the speech/noise decision of the voice activity detection device to control the updating of the background noise estimate.

A voice activity detection device and a communication device according to the invention is characterized by that it comprises means for dividing said input signal in subsignals representing specific frequency bands, means for estimating noise in the subsignals, means for calculating subdecision signals on basis of the noise in the subsignals, and means for making a voice activity decision for the input signal on basis of the subdecision signals.

A method according to the invention is characterized by that it comprises the steps of dividing said input signal in subsignals representing specific frequency bands, estimating noise in the subsignals, calculating subdecision signals on basis of the noise in the subsignals, and making a voice activity decision for the input signal on basis of the subdecision signals.

BRIEF DESCRIPTION OF THE DRAWINGS

In the following, the invention is illustrated in more detail, referring to the enclosed figures, in which.

DETAILED DESCRIPTION

Figure 1:
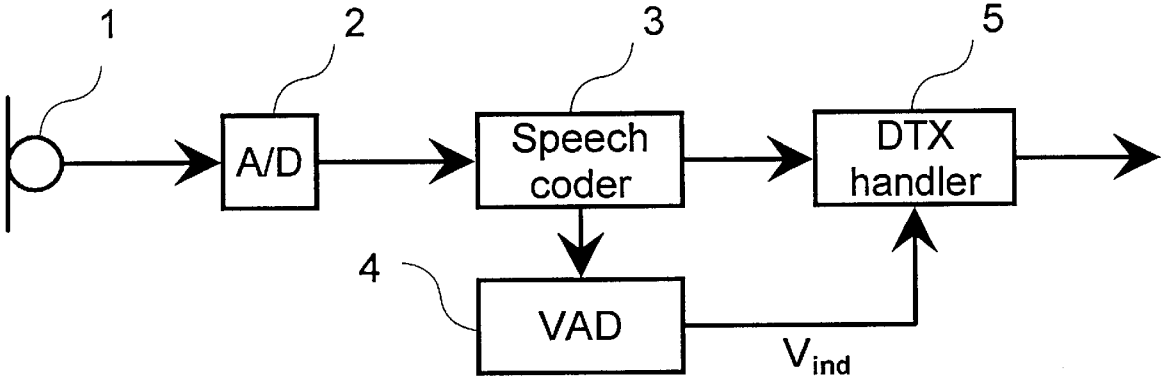
FIG. 1 presents a block diagram of a surroundings of use of a VAD according to the invention.

FIG. 1 shows shortly the surroundings of use of the voice activity detection device 4 according to the invention. The parameter values presented in the following description are exemplary values and describe one embodiment of the invention, but they do not by any means limit the function of the method according to the invention to only certain parameter values. Referring to FIG. 1 a signal coming from a microphone 1 is sampled in an A/D converter 2. As exemplary values it is assumed that the sample rate of the AND converter 2 is 8000 Hz, the frame length of the speech coder 3 portion of a speech coder/decoder (codec) is 80 samples, and each speech frame comprises 10 ms of speech. Hereinafter the speech coder 3 may be referred to as a "speech codec 3" or simply as a "codec 3", it being realized that only the speech coder portion is germane to an understanding of this invention, and not the decoder portion per se. The VAD device 4 can use the same input frame length as the speech codec 3 or the length can be an even quotient of the frame length used by the speech codec. The coded speech signal is fed further in a transmission branch, e.g. to a discontinous transmission handler 5, which controls transmission according to a decision $V_{ind}$ received from the VAD 4.

Figures 2, 12:
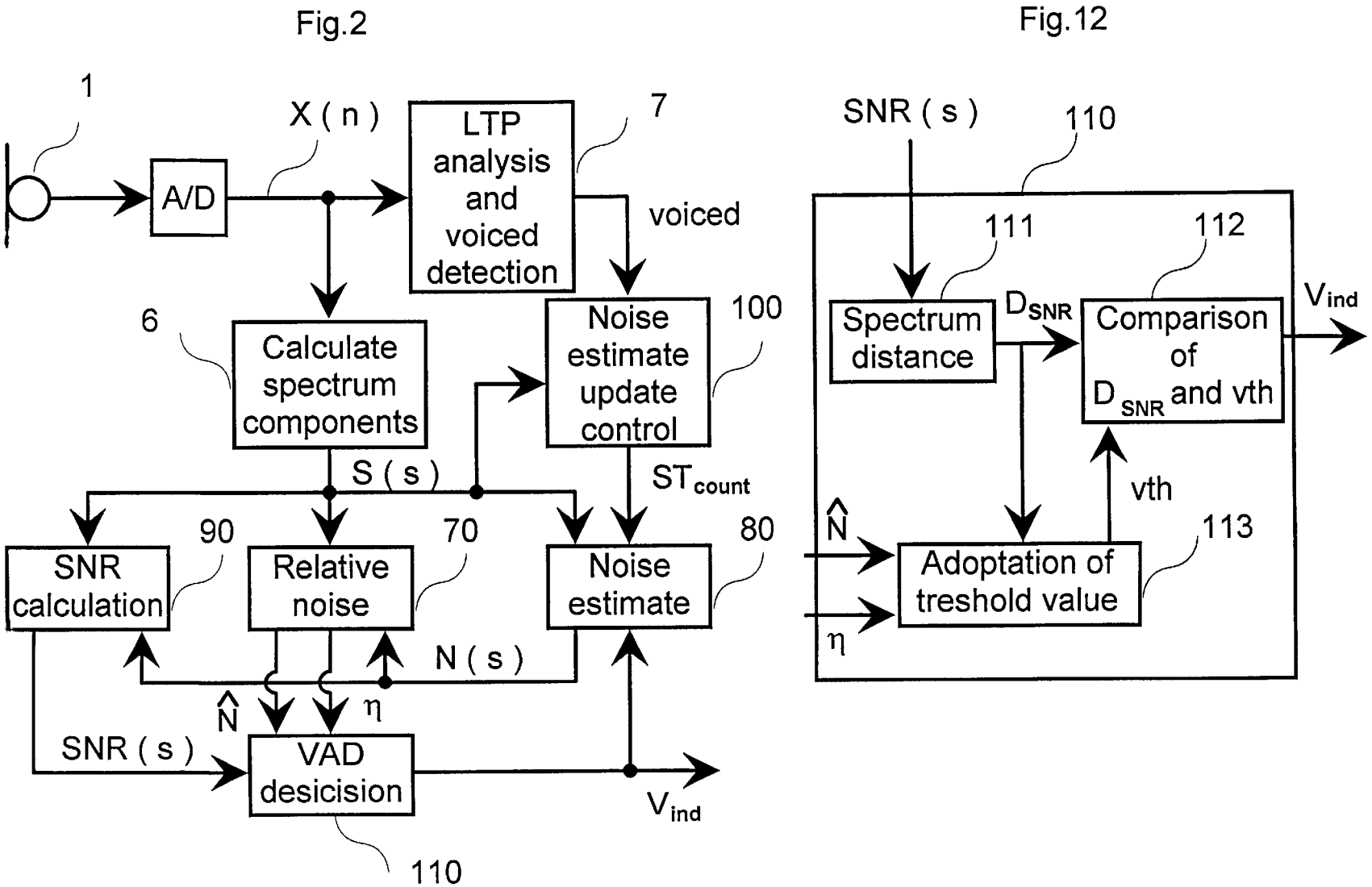
FIG. 2 presents in the form of a block diagram a realization of a VAD according to the invention.
FIG. 12 presents in form of a block diagram a realization of a VAD decision block.

One embodiment of the voice activity detection device according to the invention is described in more detail in FIG. 2. A speech signal coming from the microphone 1 is sampled in an A/D-converter 2 into a digital signal x(n). An input frame for the VAD device in FIG. 2 is formed by taking samples from digital signal x(n). This frame is fed into block 6 in which power spectrum components presenting power in predefined bands are calculated. Components proportional to amplitude or power spectrum of the input frame can be calculated using an FFT, a filter bank, or using linear predictor coefficients. This will be explained in more detail later. If the VAD operates with a speech codec that calculates linear prediction coefficients then those coefficients can be received from the speech codec.

Figure 3:
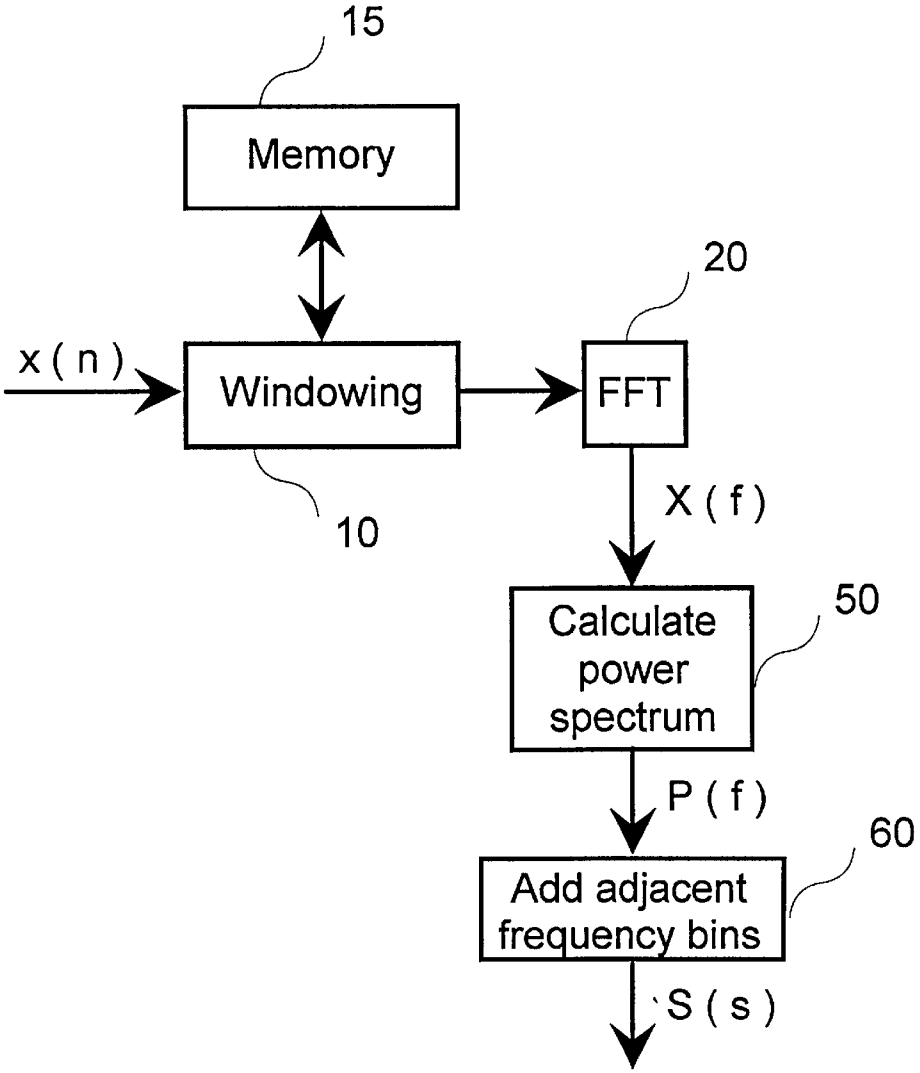
FIG. 3 presents a realization of the power spectrum calculation block in FIG. 2.

Power spectrum components P(f) are calculated from the input frame using first Fast Fourier Transform (FFT) as presented in FIG. 3. In the example solution it is assumed that the length of the FFT calculation is 128. Additionally, power spectrum components P(f) are recombined to calculation spectrum components S(s) reducing the number of spectrum components from 65 to 8.

Referring to FIG. 3 a speech frame is brought to windowing block 10 in which it is multiplied by a predetermined window. The purpose of windowing is in general to enhance the quality of the spectral estimate of a signal and to divide the signal into frames in time domain. Because in the windowing used in this example windows partly overlap, the overlapping samples are stored in a memory (block 15) for the next frame. 80 samples are taken from the signal and they are combined with 16 samples stored during the previous frame, resulting in a total of 96 samples. Respectively out of the last collected 80 samples, the last 16 samples are stored for being used in calculating the next frame.

Figure 6:
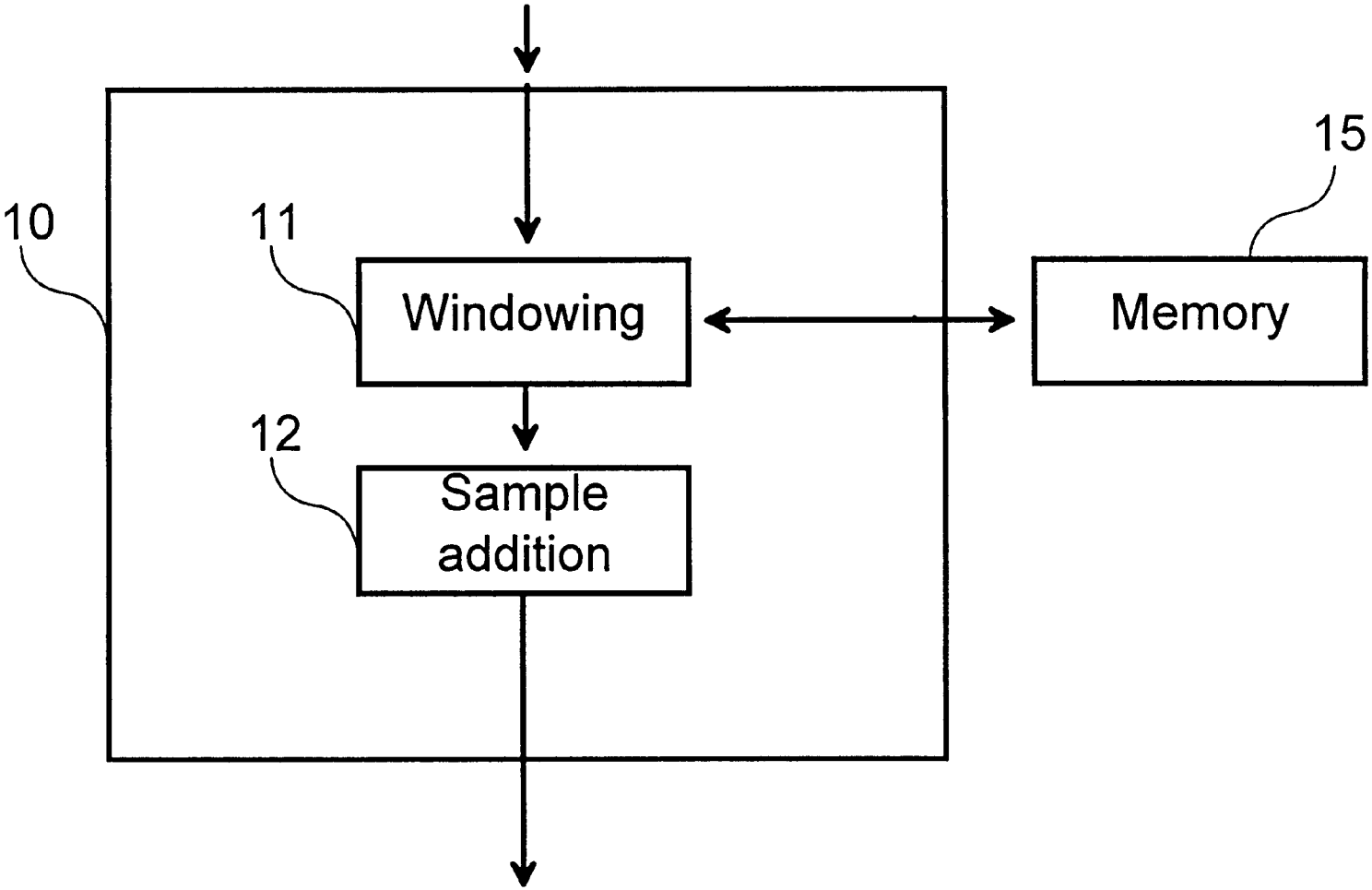
FIG. 6 presents in the form of a block diagram a realization of a windowing block.
Figure 7:
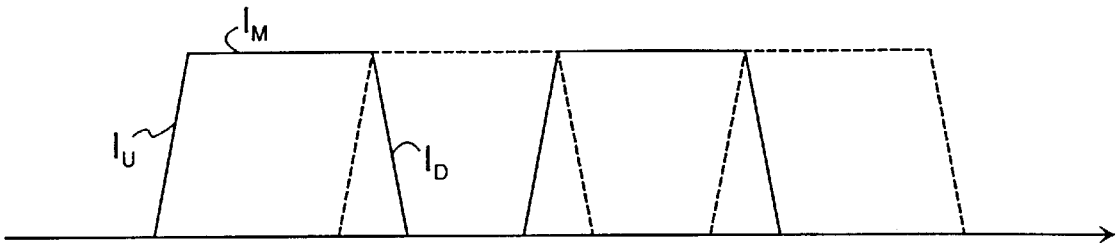
FIG. 7 presents subsequent speech signal frames in windowing according to the invention.

The 96 samples given this way are multiplied in windowing block 10 by a window comprising 96 sample values, the 8 first values of the window forming the ascending strip $I_u$ of the window, and the 8 last values forming the descending strip $I_D$ of the window, as presented in FIG. 7. The window I(n) can be defined as follows and is realized in block 11 (FIG. 6):

$$I(n)=(n+1)/9=I_U n=0, \ldots ,7$$

$$I(n)=1=I_M n=8, \ldots , 87$$

$$I(n)=(96-n)/9=I_D n=88, \ldots ,95 \quad (1)$$

Realizing of windowing (block 11) digitally is prior known to a person skilled in the art of digital signal processing. It should be noted that in the window the middle 80 values (n=8, . . 87 or the middle strip $I_M$) are equal to 1 and accordingly multiplication by them does not change the result and the multiplication can be omitted. Thus only the first 8 samples and the last 8 samples in the window need to be multiplied. Because the length of an FFT has to be a power of two, in block 12 (FIG. 6) 32 zeroes (0) are added at the end of the 96 samples obtained from block 11 resulting in a speech frame comprising 128 samples. Adding samples at the end of a sequence of samples is a simple operation and the realization of block 12 digitally is within the skills of a person skilled in the art.

After windowing has been carried out in windowing block 10 the spectrum of a speech frame is calculated in block 20 employing the Fast Fourier Transform, FFT. Samples x(0), x(1), . . . ,x(n); n=127 (or said 128 samples) in the frame arriving to FFT block 20 are transformed to frequency domain employing real FFT (Fast Fourier Transform), giving frequency domain samples X(0),X(1), . . . ,X(f);f=64 (more generally f=(n+1)/2), in which each sample comprises a real component $X_r(f)$ and an imaginary component $X_i(f)$:

$$X(f)=X_r(f)+jX_i(f), \quad (2)$$

f=0, . . . ,64

Realizing Fast Fourier Transform digitally is prior known to a person skilled in the art. The real and imaginary components obtained from the FFT are squared and added together in pairs in squaring block 50 the output of which is the power spectrum of the speech frame. If the FFT length is 128 the number of power spectrum components obtained is 65 which is obtained by dividing the length of the FFT transformation by two and incrementing the result with 1 in other words the length of FFT/2+1. Accordingly, the power spectrum is obtained from squaring block 50 by calculating the sum of the second powers of the real and imaginary components, component by component:

$$P(f)=X_r^2(f)+X_i^2(f), \quad (3)$$

f=0, . . . , 64

Figure 8:
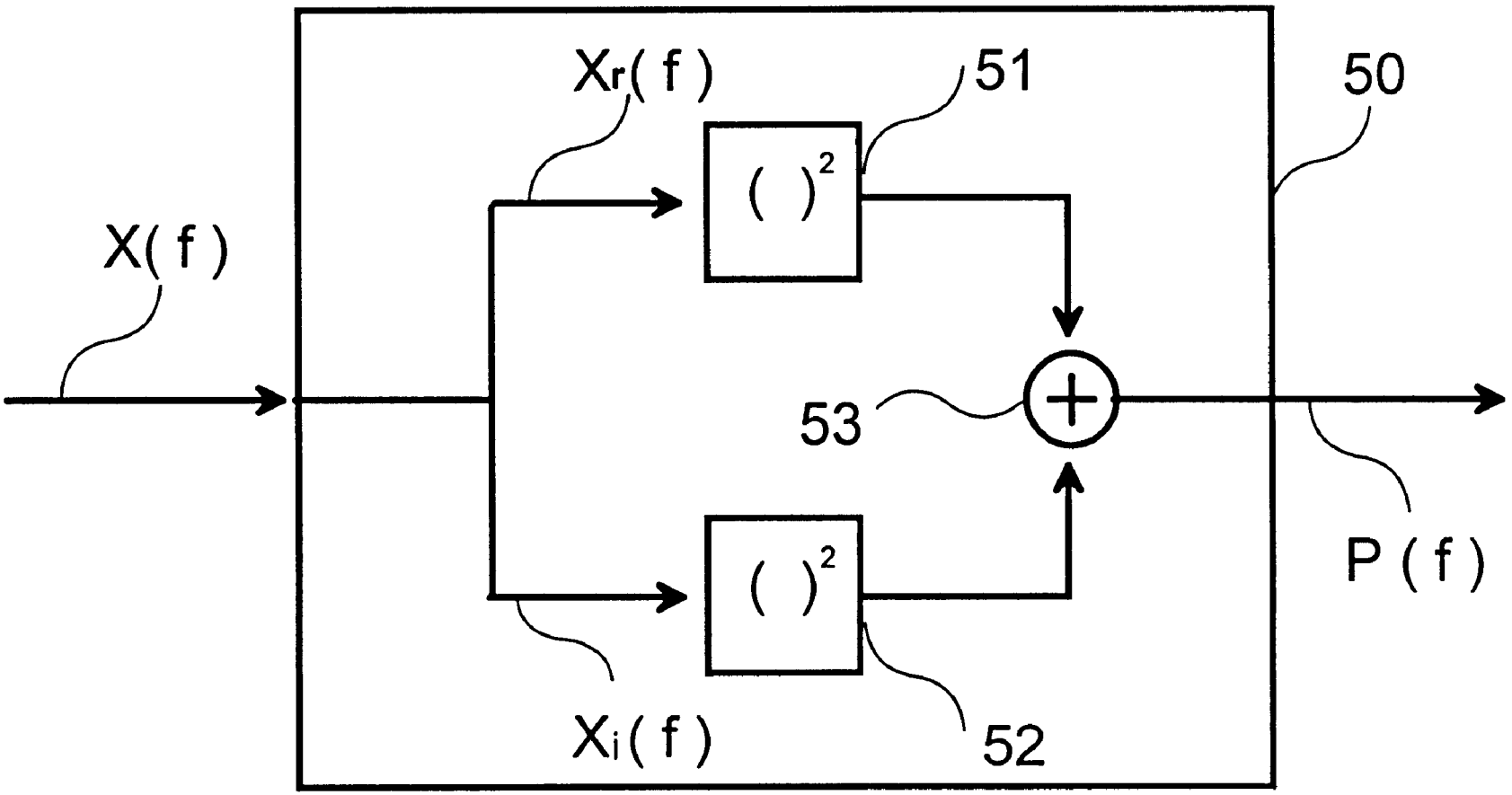
FIG. 8 presents a realization of a squaring block.

The function of squaring block 50 can be realized, as is presented in FIG. 8, by taking the real and imaginary components to squaring blocks 51 and 52 (which carry out a simple mathematical squaring, which is prior known to be carried out digitally) and by summing the squared components in a summing unit 53. In this way, as the output of squaring block 50 power spectrum components P(0), P(1), . . . ,P(f);f=64 are obtained and they correspond to the powers of the components in the time domain signal at different frequencies as follows (presuming that 8 kHz sampling frequency is used):

$$P(f) \text{ for values } f=0, \ldots ,64 \text{ corresponds to middle frequencies } (f\cdot 4000/64 \text{ Hz}) \quad (4)$$

After this 8 new power spectrum components, or power spectrum component combinations S(s), s=0, . . . 7 are formed in block 60 and they are here called calculation spectrum components. The calculation spectrum components S(s) are formed by summing always 7 adjacent power spectrum components P(f) for each calculation spectrum component S(s) as follows:

$$S(0)=P(1)+P(2)+\ldots +P(7)$$

$$S(1)=P(8)+P(9)+\ldots +P(14)$$

$$S(2)=P(15)+P(16)+\ldots +P(21)$$

$$S(3)=P(22)+\ldots +P(28)$$

$$S(4)=P(29)+\ldots +P(35)$$

$$S(5)=P(36)+\ldots +P(42)$$

$$S(6)=P(43)+\ldots +P(49)$$

$$S(7)=P(50)+\ldots +P(56) \quad (5)$$

Figure 9:
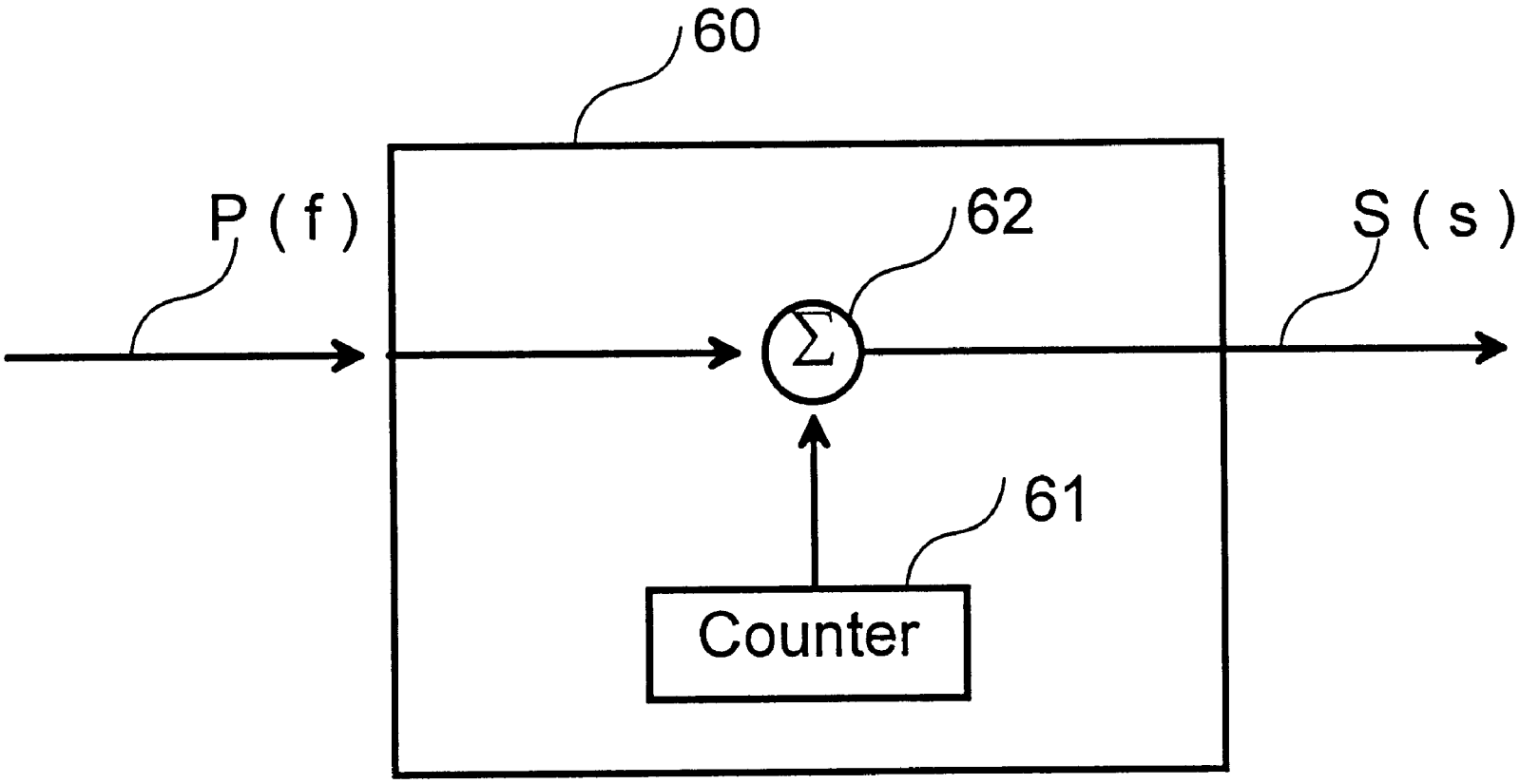
FIG. 9 presents a realization of a spectral recombination block.

This can be realized, as presented in FIG. 9, utilizing counter 61 and summing unit 62 so that the counter 61 always counts up to seven and, controlled by the counter, summing unit 62 always sums seven subsequent components and produces a sum as an output. In this case the lowest combination component S(0) corresponds to middle frequencies [62.5 Hz to 437.5 Hz] and the highest combination component S(7) corresponds to middle frequencies [3125 Hz to 3500 Hz]. The frequencies lower than this (below 62.5 Hz) or higher than this (above 3500 Hz) are not essential for speech and can be ignored.

Figure 4:
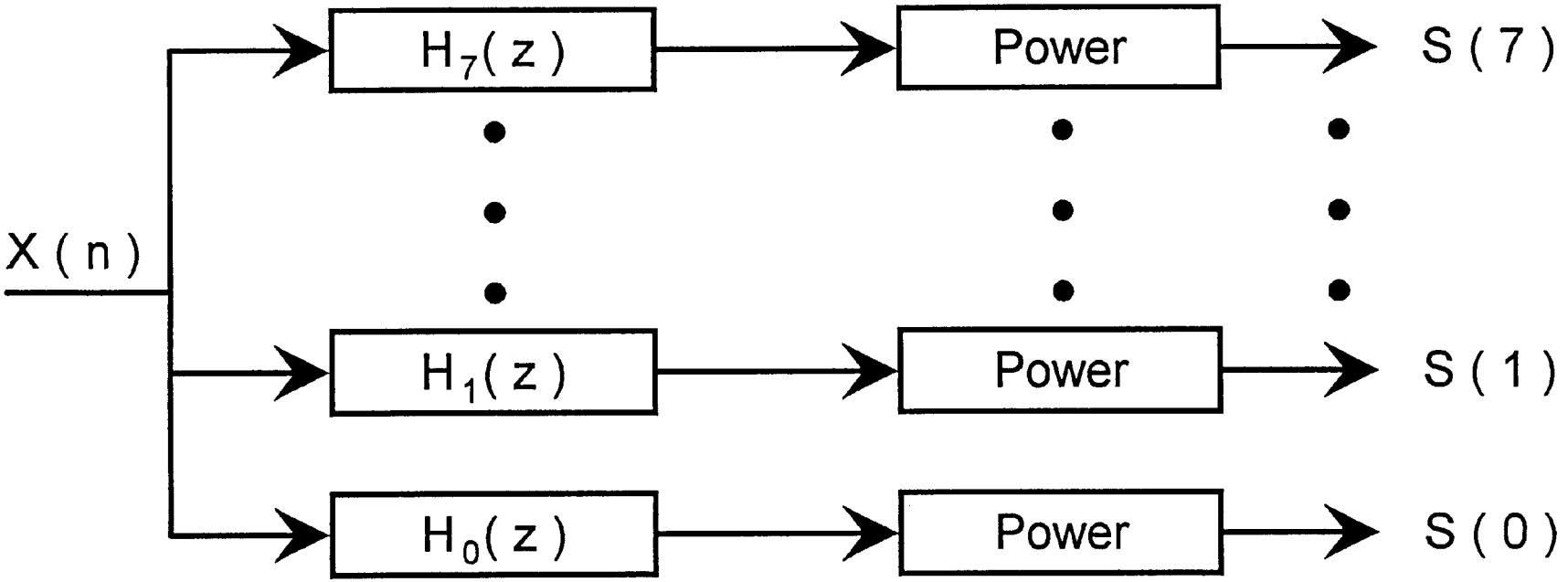
FIG. 4 presents an alternative realization of the power spectrum calculation block.

Instead of using the solution of FIG. 3, power spectrum components P(f) can also be calculated from the input frame using a filter bank as presented in FIG. 4. The filter bank comprises bandpass filters $H_j(z)$, j=0, . . . ,7; covering the frequency band of interest. The filter bank can be either uniform or composed of variable bandwidth filters. Typically, the filter bank outputs are decimated to improve efficiency. The design and digital implementation of filter banks is known to a person skilled in the art. Sub-band samples $z_j(i)$in each band j are calculated from the input signal x(n) using filter $H_j(z)$. Signal power at each band can be calculated as follows:

$$S(j) = \sum_{i=0}^{L-1} z_j(i) \cdot z_j(i) \tag{6}$$

where, L is the number of samples in the sub-band within one input frame.

When a VAD is used with a speech codec, the calculation spectrum components S(s) can be calculated using Linear Prediction Coefficients (LPC), which are calculated by most of the speech codecs used in digital mobile phone systems. Such an arrangement is presented in FIG. 5. LPC coefficients are calculated in a speech codec 3 using a technique called linear prediction, where a linear filter is formed. The LPC coefficients of the filter are direct order coefficients d(i), which can be calculated from autocorrelation coefficients ACF(k). As will be shown below, the direct order coefficients d(i) can be used for calculating calculation spectrum components S(s). The autocorrelation coefficients ACF(k), which can be calculated from input frame samples x(n), can be used for calculating the LPC coefficients. If LPC coefficients or ACF(k) coefficients are not available from the speech codec, they can be calculated from the input frame.

Autocorrelation coefficients ACF(k) are calculated in the speech codec 3 as follows:

$$ACF(k) = \sum_{i=k}^{N} x(i)x(i-k),\ k = 0, 1, \ldots, M \tag{7}$$

where,

N is the number of samples in the input frame,

M is the LPC order (e.g., 8), and x(i) are the samples in the input frame.

LPC coefficients d(i), which present the impulse response of the short term analysis filter, can be calculated from the autocorrelation coefficients ACF(k) using a previously known method, e.g., the Schur recursion algorithm or the Levinson-Durbin algorithm.

Figure 5:
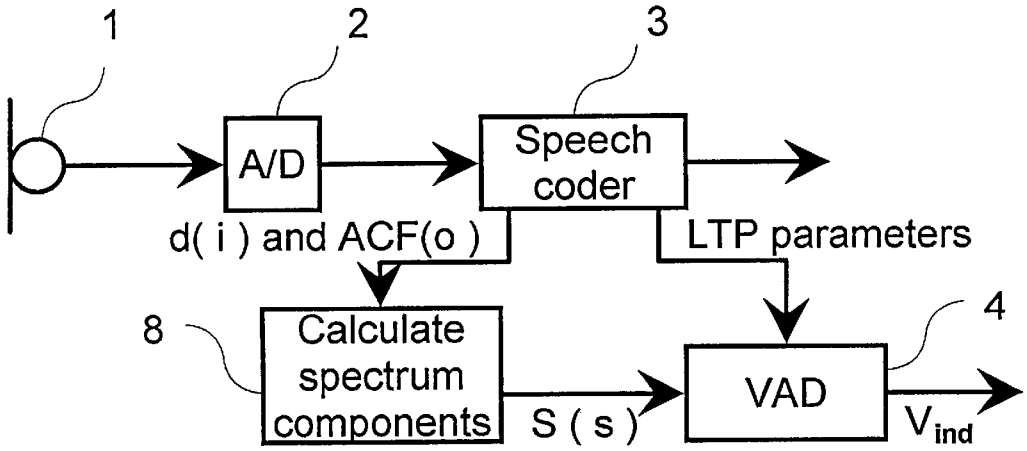
FIG. 5 presents in the form of a block diagram another embodiment of the device according to the invention.

Amplitude at desired frequency is calculated in block 8 shown in FIG. 5 from the LPC values using Fast Fourier Transform (FFT) according to following equation:

$$A(k) = \frac{1}{M^{\frac{1}{2}}} \left| \sum_{i=0}^{M-1} d(i) e^{-ij2\pi k/K} \right| \tag{8}$$

where,

K is a constant, e.g. 8000 k corresponds to a frequency for which power is calculated (i.e., A(k) corresponds to frequency k/K*fs, where fs is the sample frequency), and M is the order of the short term analysis.

The amplitude of a desired frequency band can be estimated as follows $$A(k1, k2) = \frac{1}{M^{\frac{1}{2}}} \left| \sum_{i=0}^{M-1} d(i) C(k1, k2, i) \right| \tag{9}$$

where k1 is the start index of the frequency band and k2 is the end index of the frequency band.

The coefficients C(k1, k2, i) can be calculated forehand and they can be saved in a memory (not shown) to reduce the required computation load. These coefficients can be calculated as follows:

$$C(k1, k2, i) = \sum_{k=k1}^{k2} e^{-ij2\pi k/K} \tag{10}$$

An approximation of the signal power at calculation spectrum component S(s) can be calculated by inverting the square of the amplitude A(k1,k2) and by multiplying with ACF(0). The inversion is needed because the linear predictor coefficients presents inverse spectrum of the input signal. ACF(0) presents signal power and it is calculated in the equation 7.

$$S(s) = \frac{ACF(0)}{A(k1, k2)^2} \tag{11}$$

where each calculation spectrum component S(s) is calculated using specific constants k1 and k2 which define the band limits. Above different ways of calculating the power (calculation) spectrum components S(s) have been described.

Further in FIG. 2 the spectrum of noise N(s), s=0, . . . ,7 is estimated in estimation block 80 (presented in more detail in FIG. 11) when the voice activity detector does not detect speech. Estimation is carried out in block 80 by calculating recursively a time-averaged mean value for each spectrum component S(s), s=0, . . . ,7 of the signal brought from block 6:

$$N_n(s) = \lambda(s) N_{n-1}(s) + (1-\lambda(s)) S(s) \tag{12}$$

s=0, . . . ,7.

Figure 11:
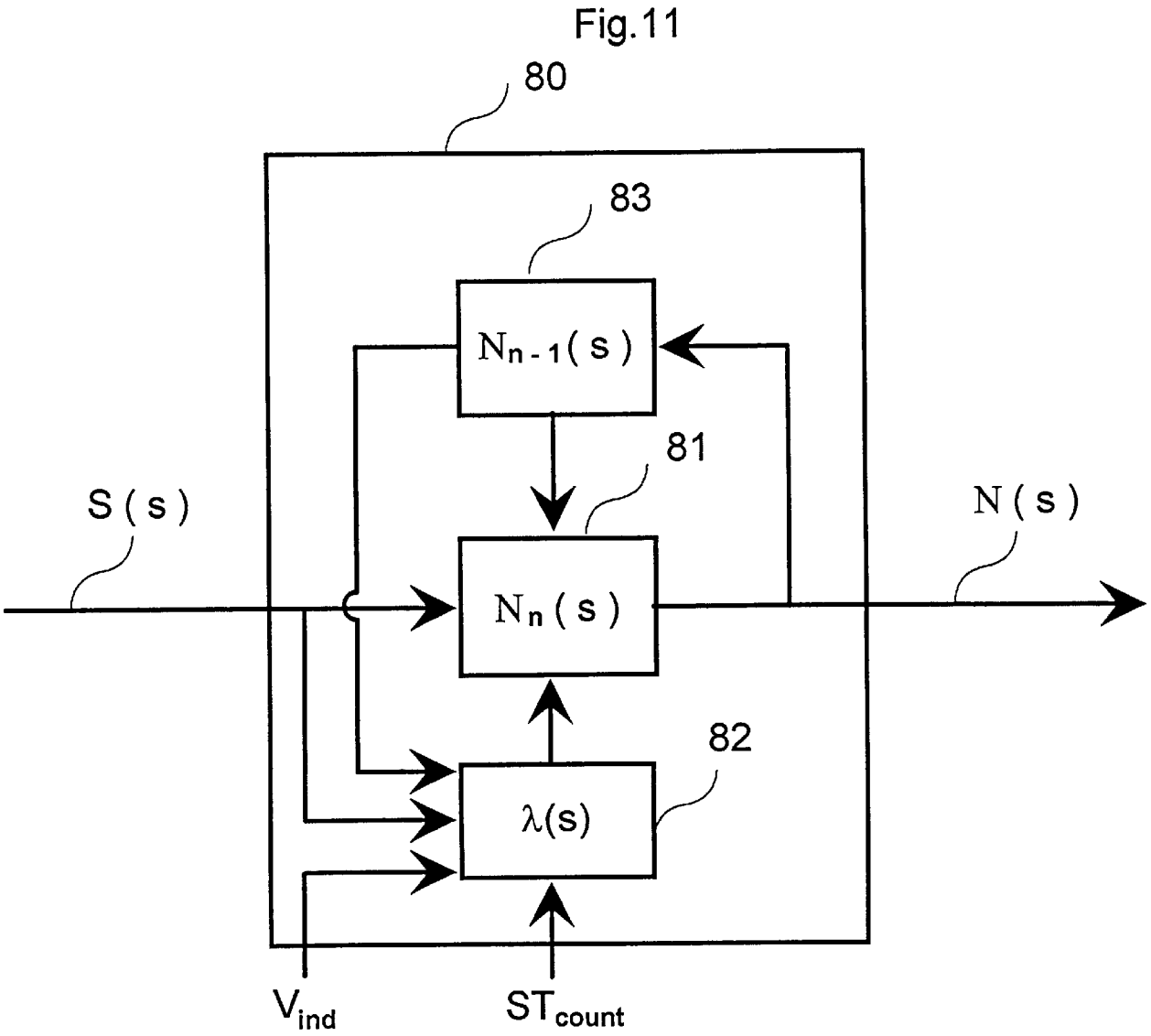
FIG. 11 presents an arrangement for calculating a background noise model.

In this context $N_{n-1}(s)$ means a calculated noise spectrum estimate for the previous frame, obtained from memory 83 as presented in FIG. 11, and $N_n(s)$ means an estimate for the present frame (n=frame order number) according to the equation above. This calculation is carried out preferably digitally in block 81 the inputs of which are the spectrum components S(s) from block 6 the estimate for the previous frame $N_{n-1}(s)$ obtained from memory 83 and the value for time-constant variable λ(s) calculated in block 82. The updating can be done using faster time-constant when input spectrum components are S(s) lower than noise estimate component $N_{n-1}(s)$ components. The value of the variable λ(s) is determined according to the next table (typical values for λ(s)):

| $S(s) < N_{n-1}(s)$ | $(V_{ind}, ST_{count})$ | $\lambda(s)$ |
|---|---|---|
| Yes | (0,0) | 0.85 |
| No | (0,0) | 0.9 |
| Yes | (0,1) | 0.85 |
| No | (0,1) | 0.9 |
| Yes | (1,0) | 0.9 |
| No | (1,0) | 1 (no updating) |
| Yes | (1,1) | 0.9 |
| No | (1,1) | 0.95 |

The values $V_{ind}$ and $ST_{count}$ are explained more closely later on.

In following the symbol N(s) is used for the noise spectrum estimate calculated for the present frame. The calculation according to the above estimation is preferably carried out digitally. Carrying out multiplications, additions and subtractions according to the above equation digitally is well known to a person skilled in the art.

Further in FIG. 2 a ratio SNR(s), s=0, . . . ,7 is calculated from input spectrum S(s) and noise spectrum N(s), component by component, in calculation block 90 and the ratio is called signal-to-noise ratio:

$$SNR(s) = \frac{S(s)}{N(s)}. \tag{13}$$

The signal-to-noise ratios SNR(s) represent a kind of voice activity decisions for each frequency band of the calculation spectrum components. From the signal-to-noise ratios SNR (s) it can be determined whether the frequency band signal contains speech or noise and accordingly it indicates voice activity. The calculation block 90 is also preferably realized digitally, and it carries out the above division. Carrying out a division digitally is as such prior known to a person skilled in the art.

Figure 10:
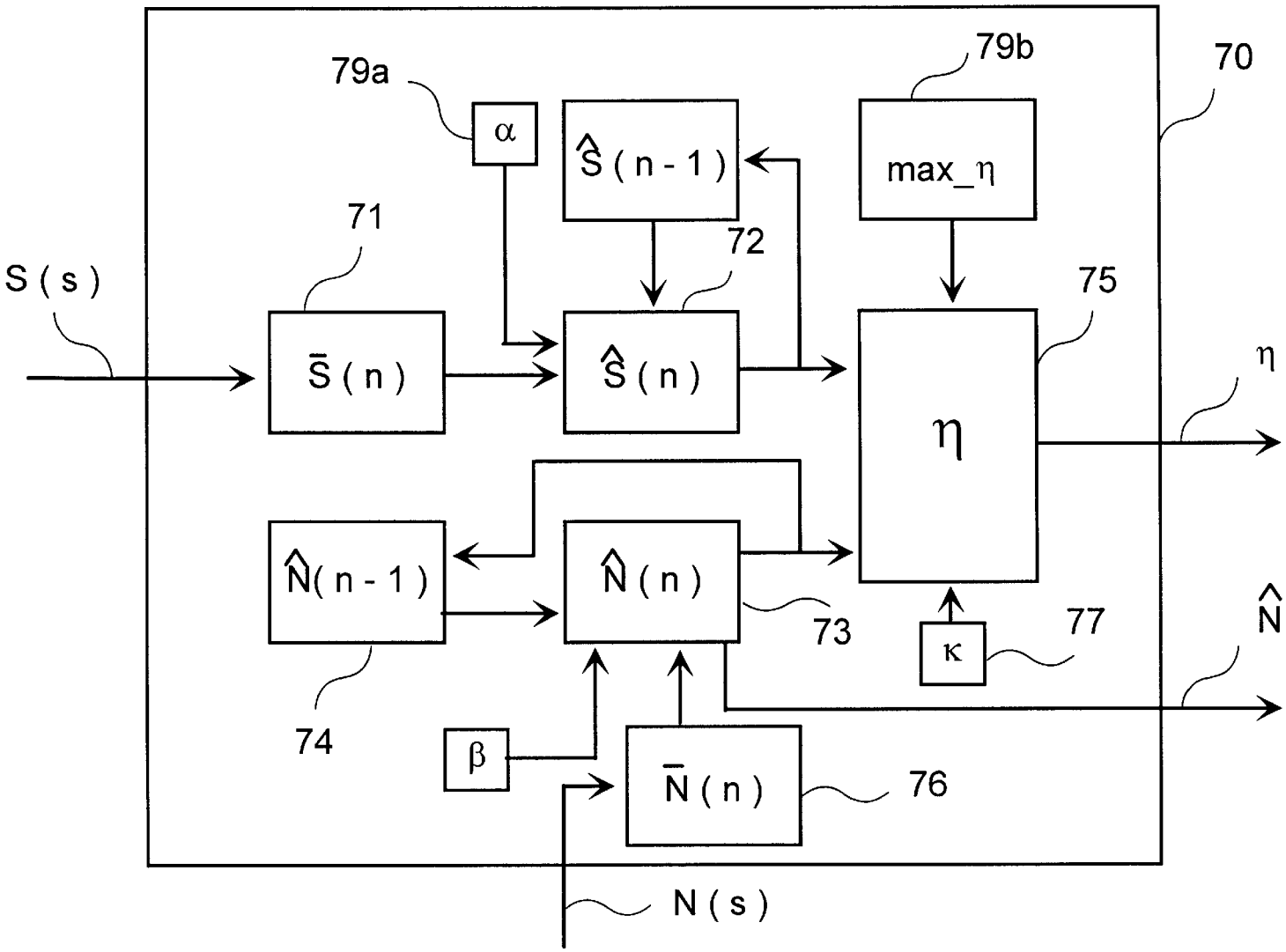
FIG. 10 presents a realization of a block for calculation of relative noise level.

In FIG. 2 relative noise level is calculated in block 70 which is more closely presented in FIG. 10, and in which the time averaged mean value for speech $\hat{S}(n)$ is calculated using the power spectrum estimate S(s), S=0, . . . ,7. The time averaged mean value $\hat{S}(n)$ is updated when speech is detected. First the mean value $\overline{S}(n)$ of power spectrum components in the present frame is calculated in block 71 into which spectrum components S(s) are obtained as an input from block 60 as follows:

$$\overline{S}(n) = \frac{1}{8}\sum_{s=0}^{7} S(s). \tag{14}$$

The time averaged mean value $\hat{S}(n)$ is obtained by calculating in block 72 (e.g., recursively) based upon a time averaged mean value $\hat{S}(n-1)$ for the previous frame, which is obtained from memory 78 in which the calculated time averaged mean value has been stored during the previous frame, the calculation spectrum mean value $\overline{S}(n)$ obtained from block 71 and time constant $\alpha$ which has been stored in advance in memory 79*a:*

$$\hat{S}(n)=\alpha\hat{S}(n-1)+(1-\alpha)\overline{S}(n), \tag{15}$$

in which n is the order number of a frame and $\alpha$ is said time constant, the value of which is from 0.0 to 1.0 typically between 0.9 to 1.0. In order not to contain very weak speech in the time averaged mean value (e.g. at the end of a sentence), it is updated only if the mean value of the spectrum components for the present frame exceeds a threshold value dependent on time averaged mean value. This threshold value is typically one quarter of the time averaged mean value. The calculation of the two previous equations is preferably executed digitally.

Correspondingly, the time averaged mean value of noise power $\hat{N}(n)$ is obtained from calculation block 73 by using the power spectrum estimate of noise N(s), s=0, . . . ,7 and component mean value $\overline{N}(n)$ calculated from it according to the next equation:

$$\hat{N}(n)=\beta(n-1)+(1-\beta)\overline{N}(n), \tag{16}$$

in which $\beta$ is a time constant, the value of which is 0.0. to 1.0 typically between 0.9 to 1.0. The noise power time averaged mean value is updated in each frame. The mean value of the noise spectrum components $\overline{N}(n)$ is calculated in block 76 based upon spectrum components N(s), as follows:

$$\overline{N}(n) = \frac{1}{8}\sum_{s=0}^{7} N(s) \tag{17}$$

and the noise power time averaged mean value $\hat{N}(n-1)$ for the previous frame is obtained from memory 74 in which it was stored during the previous frame. The relative noise level $\eta$ is calculated in block 75 as a scaled and maximum limited quotient of the time averaged mean values of noise and speech $$\eta = \min\left(\max_\eta, \kappa\frac{\hat{N}}{\hat{S}}\right), \tag{18}$$

in which $\kappa$ is a scaling constant (typical value 4.0), which has been stored in advance in memory 77 and max_n is the maximum value of relative noise level (typically 1.0), which has been stored in memory 79*b*.

For producing a VAD decision in the device in FIG. 2, a distance $D_{SNR}$ between input signal and noise model is calculated in the VAD decision block 110 utilizing signal-to-noise ratio SNR(s), which by digital calculation realizes the following equation:

$$D_{SNR} = \sum_{s=s_l}^{s_h} \upsilon_s SNR(s); \tag{19}$$

in which s_l and s_h are the index values of the lowest and highest frequency components included and $\nu_s$=component weighting coefficient, which are predetermined and stored in advance in a memory, from which they are retrieved for calculation. Typically, all signal-to-noise estimate value components are used (s_l=0 and s_h=7), and they are weighted equally: $\nu_s$=1.0/8.0; s=0, . . . ,7.

The following is a closer description of the embodiment of a VAD decision block 110 with reference to FIG. 12. A summing unit 111 in the voice activity detector sums the values of the signal-to-noise ratios SNR(s), obtained from different frequency bands, whereby the parameter $D_{SNR}$, describing the spectrum distance between input signal and noise model, is obtained according to the above equation (19), and the value $D_{SNR}$ from the summing unit 111 is compared with a predetermined threshold value vth in comparator unit 112. If the threshold value vth is exceeded, the frame is regarded to contain speech. The summing can also be weighted in such a way that more weight is given to the frequencies, at which the signal-to-noise ratio can be expected to be good. The output and decision of the voice activity detector can be presented with a variable $V_{ind}$, for the values of which the following conditions are obtained:

$$\begin{cases} V_{ind} = 1; & D_{SNR} > vth \\ V_{ind} = 0; & D_{SNR} \leq vth \end{cases}. \tag{20}$$

Because the VAD controls the updating of background spectrum estimate N(s), and the latter on its behalf affects the function of the voice activity detector in a way described above, it is possible that both noise and speech is indicated as speech ($V_{ind=1}$) if the background noise level suddenly increases. This further inhibits update of the background spectrum estimate N(s). To prevent this, the time (number of frames) during which subsequent frames are regarded not to contain speech is monitored. Subsequent frames, which are stationary and are not indicated voiced are assumed not to contain speech.

In block 7 in FIG. 2, Long Term Prediction (LTP) analysis, which is also called pitch analysis, is calculated. Voiced detection is done using long term predictor parameters. The long term predictor parameters are the lag (i.e. pitch period) and the long term predictor gain. Those parameters are calculated in most of the speech coders. Thus if a voice activity detector is used besides a speech codec (as described in FIG. 5), those parameters can be obtained from the speech codec.

The long term prediction analysis can be calculated from an amount of samples M which equals frame length N, or the input frame length can be divided to sub-frames (e.g. 4 sub-frames, 4* M=N) and long term parameters are calculated separately from each sub-frame. The division of the input frame into these sub-frames is done in the LTP analysis block 7 (FIG. 2). The sub-frame samples are denoted xs(i).

Accordingly, in block 7 first auto-correlation R(l) from the sub-frame samples xs(i) is calculated, $$R(l) = \sum_{i=0}^{M} xs(i) \cdot xs(i-l) \tag{21}$$

where l=Lmin, . . . ,Lmax (e.g. Lmin=40 Lmax=160)

Last Lmax samples from the old sub-frames must be saved for the above mentioned calculation.

Then a maximum value Rmax from the R(l) is searched so that Rmax=max(R(l)), where l=40, . . . ,160.

The long term predictor lag LTP_lago) is the index l with corresponds to Rmax. Variable j indicates the index of the sub-frame (j=0 . . . 3).

LTP_gain can be calculated as follows:

LTP_gain(j)=Rmax/Rtot where $$Rtot = \sum_{i=0}^{N} xs(i - \text{LTP_lag}(j))^2 \tag{22}$$

A parameter presenting the long term predictor lag gain of a frame (LTP_gain_sum) can be calculated by summing the long term predictor lag gains of the sub-frames (LTP_gain)(j))

$$\text{LTP_gain_sum} = \sum_{j=0}^{3} \text{LTP_gain}(j) \tag{23}$$

If the LTP_gain_sum is higher than a fixed threshold thr_lag, the frame is indicated to be voiced:

If (LTP_gain_sum>thr_lag)

voiced=1 else voiced=0

Further in FIG. 2 an average noise spectrum estimate NA(s) is calculated in block 100 as follows:

$$NA_n(s) = aNA_{n-1}(s) + (1-a)S(s) \tag{24}$$

s=0, . . . ,7 where a is a time constant of value 0<a<1 (e.g. 0,9).

Also a spectrum distance D between the average noise spectrum estimate NA(s) and the spectrum estimate S(s) is calculated in block 100 as follows:

$$D = \sum_{S=0}^{7} \frac{\max(NA(s), S(s))}{\min(NA(s), S(s), \text{Low_Limit})} \tag{25}$$

Low_Limit is a small constant, which is used to keep the division result small when the noise spectrum or the signal spectrum at some frequency band is low.

If the spectrum distance D is larger than a predetermined threshold Dlim, a stationarity counter stat_cnt is set to zero. If the spectrum distance D is smaller that the threshold Dlim and the signal is not detected voiced (voiced=0), the stationarity counter is incremented. The following conditions are received for the stationarity counter:

If (D>Dlim)

stat_cnt=0 if (D<Dlim and voiced=0)

stat_cnt=stat_cnt+1

Block 100 gives an output stat_cnt which is reset to zero when $V_{ind}$ gets a value 0 to meet the following condition:

if ($V_{ind}$=0)

stat_cnt=0

If this number of subsequent frames exceeds a predetermined threshold value max_spf, the value of which is e.g. 50 the value of $ST_{COUNT}$ is set at 1. This provides the following conditions for an output $ST_{COUNT}$ in relation to the counter value stat_cnt:

If (stat_cnt>max_spf)

$ST_{COUNT}$=1 else $ST_{COUNT}$=0

Additionally, in the invention the accuracy of background spectrum estimate N(s) is enhanced by adjusting said threshold value vth of the voice activity detector utilizing relative noise level η (which is calculated in block 70). In an environment in which the signal-to-noise ratio is very good (or the relative noise level η is low), the value of the threshold vth is increased based upon the relative noise level η. Hereby interpreting rapid changes in background noise as speech is reduced.

Adaptation of the threshold value vth is carried out in block 113 according to the following:

$$vth1=max(vth_min1,\ vth_fix1-vth_slope1\cdot\eta), \tag{26}$$

in which vth_fix1, vth_min1, and vth_slope1 are positive constants, typical values for which are e.g.: vth_fix1=2.5; vth_min1=2.0; vth_slope1=8.0.

In an environment with a high noise level, the threshold is decreased to decrease the probability that speech is detected as noise. The mean value of the noise spectrum components $\hat{N}(n)$ is then used to decrease the threshold vth as follows $$vth2=min(vth1,\ vth_fix2-vth_slope2\cdot\hat{N}(n)) \tag{27}$$

in which vth_fix2 and vth_slope2 are positive constants. Thus if the mean value of the noise spectrum components $\hat{N}(n)$ is large enough, the threshold vht2 is lower that the theshold vth1.

The voice activity detector according to the invention can also be enhanced in such a way that the threshold vth2 is further decreased during speech bursts. This enhances the operation, because as speech is slowly becoming more quiet it could happen otherwise that the end of speech will be taken for noise. The additional threshold adaptation can be implemented in the following way (in block 113):

First, $D_{SNR}$ is limited between the desired maximum (typically 5) and minimum (typically 2) values according to the following conditions:

$D=D_{SNR}$ if $D<D_{min}$ $D=D_{min}$ if $D>D_{max}$ $D=D_{max}$

After this a threshold adaptation coefficient $ta_0$ is calculated by $$ta_0 = th_{\max} - \frac{D - D_{\min}}{D_{\max} - D_{\min}}(th_{\max} - th_{\min}), \tag{28}$$

where $th_{min}$ and $th_{max}$ are the minimum (typically 0.5) and maximum (typically 1) scaler values, respectively.

The actual scaler for frame n, ta(n), is calculated by smoothing $ta_0$ with a filter with different time constants for increasing and decreasing values. The smoothing may be performed according to following equations:

$$if\ ta_0>ta(n-1)$$

$$ta(n)=\lambda_0 ta(n-1)+(1-\lambda_0)ta_0$$

else $$ta(n)=\lambda_1 ta(n-1)+(1-\lambda_1)ta_0 \tag{29}$$

Here $\lambda_0$ and $\lambda_1$ are the attack (increase period; typical value 0.9) and release (decrease period; typical value 0.5) time constants. Finally, the scaler ta(n) can be used to scale the threshold vth in order to obtain a new VAD threshold value vth, whereby $$vth=ta(n)\cdot vth2 \tag{30}$$

An often occurring problem in a voice activity detector is that just at the beginning of speech the speech is not detected immediately and also the end of speech is not detected correctly. One result can be that the background noise estimate N(s) gets an incorrect value, which again affects later results of the voice activity detector. This problem can be eliminated by updating the background noise estimate using a delay. In this case a certain number N (e.g. N=2) of power spectra (here calculation spectra) $S_1(S), \ldots, S_N(S)$ of the last frames are stored (e.g. in a buffer implemented at the input of block 80 not shown in FIG. 11) before updating the background noise estimate N(s). If during the last double amount of frames (or during 2*N frames) the voice activity detector has not detected speech, the background noise estimate N(s) is updated with the oldest power spectrum $S_1(s)$ in memory, in any other case updating is not done. With this it is ensured, that N frames before and after the frame used at updating have been noise.

Figure 13:
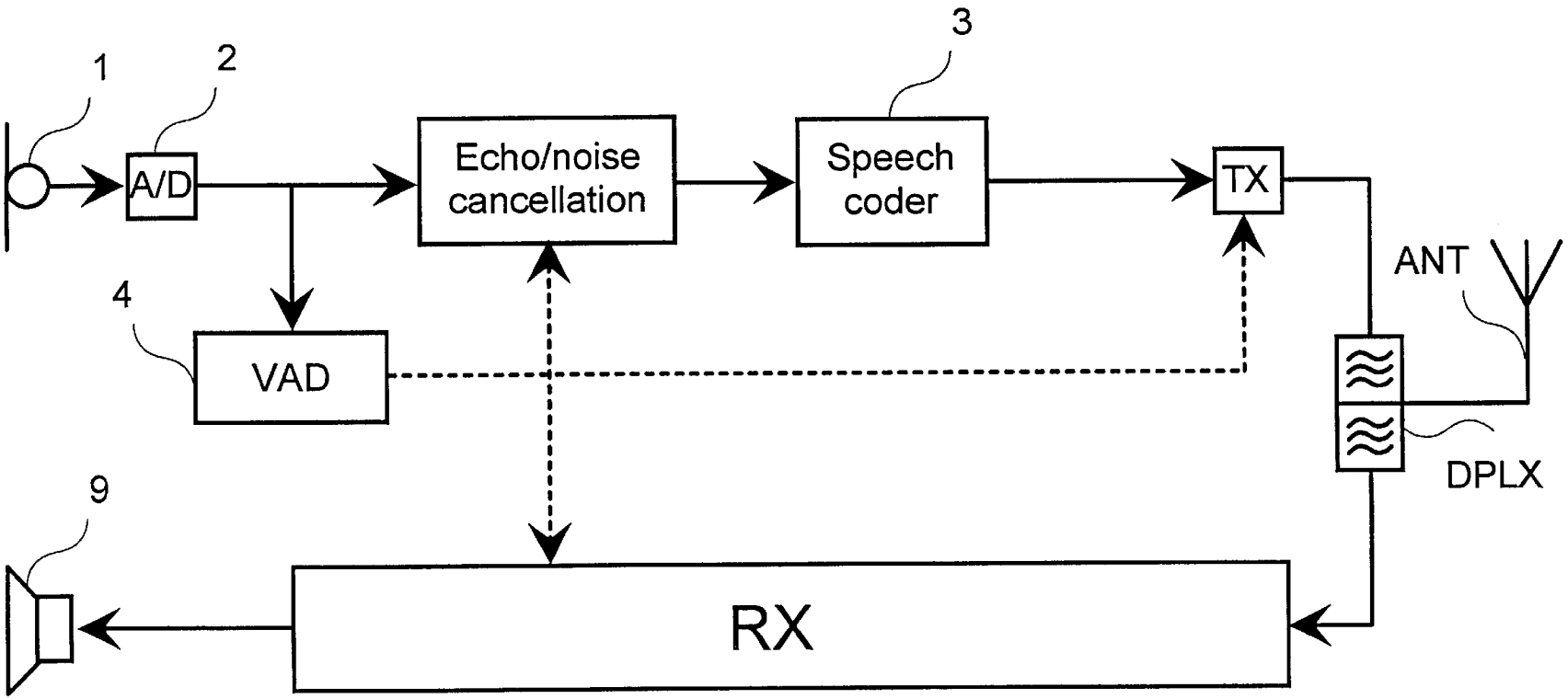
FIG. 13 presents a mobile station according to the invention.

The method according to the invention and the device for voice activity detection are particularly suitable to be used in communication devices such as a mobile station or a mobile communication system (e.g. in a base station), and they are not limited to any particular architecture (TDMA, CDMA, digital/analog). FIG. 13 presents a mobile station according to the invention, in which voice activity detection according to the invention is employed. The speech signal to be transmitted, coming from a microphone 1 is sampled in an A/D converter 2 is speech coded in the speech coder portion of the speech codec 3 after which base frequency signal processing (e.g. channel encoding, interleaving), mixing and modulation into radio frequency and transmittance is performed in block TX. The voice activity detector 4 (VAD) can be used for controlling discontinous transmission by controlling block TX according to the output $V_{ind}$ of the VAD. If the mobile station includes an echo and/or noise canceller ENC, the VAD 4 according to the invention can also be used in controlling block ENC. From block TX the signal is transmitted through a duplex filter DPLX and an antenna ANT. The known operations of a reception branch RX are carried out for speech received at reception, and it is repeated through loudspeaker 9. The VAD 4 could also be used for controlling any reception branch RX operations, e.g. in relation to echo cancellation.

Here realization and embodiments of the invention have been presented by examples on the method and the device. It is evident for a person skilled in the art that the invention is not limited to the details of the presented embodiments and that the invention can be realized also in another form without deviating from the characteristics of the invention. The presented embodiments should only be regarded as illustrating, not limiting. Thus the possibilities to realize and use the invention are limited only by the enclosed claims. Hereby different alternatives for the implementing of the invention defined by the claims, including equivalent realizations, are included in the scope of the invention.

We claim:

1. A voice activity detection devices, comprising:

means for detecting voice activity in an input signal, and means for making a voice activity decision on the basis of the detection, wherein said detecting means and decision making means comprises means for dividing said input signal into subsignals each representing a specific frequency band, means for estimating noise in the subsignals, means for calculating subdecision signals on the basis of the estimated noise in the subsignals, and means for making a voice activity decision for the input signal on the basis of the calculated subdecision signals.

2. A voice activity detection device according to claim 1, and further comprising means for calculating a signal-to-noise ratio for each subsignal and for providing said calculated signal-to-noise ratios as said subdecision signals.

3. A voice activity detection device according to claim 2, wherein the means for making a voice activity decision for the input signal comprises means for creating a value based on said calculated signal-to-noise ratios, and means for comparing said value to a threshold value and for outputting a voice activity decision signal on the basis of said comparison.

4. A voice activity detection device according to claim 3, and further comprising means for determining a mean level of a noise component and a speech component contained in the input signal, and means for adjusting said threshold value based upon the determined mean level of the noise component and the speech component.

5. A voice activity detection device according to claim 3, and further comprising means for adjusting said threshold value based upon past signal-to-noise ratios.

6. A voice activity detection device according to claim 2, and further comprising means for storing the value of the estimated noise, and wherein said stored estimated noise is updated with past subsignals depending on past and present signal-to-noise ratios.

7. A voice activity detection device according to claim 1, and further comprising means for calculating linear prediction coefficients based on the input signal, and wherein said means for calculating said subsignals calculates said subsignals based on said calculated linear prediction coefficients.

8. A voice activity detection device according to claim 1, and further comprising:

means for calculating a long term prediction analysis producing long term predictor parameters, said parameters including long term predictor gain, means for comparing said long term predictor gain with a threshold value, and means for producing a voice detection decision oh the basis of said comparison.

9. A mobile station for transmission and reception of speech messages, comprising:

means for detecting voice activity in a speech message, and means for making a voice activity decision on the basis of the detection, wherein said detecting means and decision making means comprises means for dividing said speech message into subsignals each representing a specific frequency band, means for estimating noise in the subsignals, means for calculating subdecision signals on the basis of the estimated noise in the subsignals, and means for making a voice activity decision for the input signal on the basis of the calculated subdecision signals.

10. A method of detecting voice activity in a communication device, the method comprising the steps of:

receiving an input signal, detecting voice activity in the input signal, and making a voice activity decision on basis of the detection, wherein the steps of detecting and making a voice activity decision comprise steps of, dividing said input signal into subsignals representing specific frequency bands, estimating noise in the subsignals, calculating subdecision signals on the basis of the estimated noise in the subsignals, and making the voice activity decision for the input signal on the basis of the calculated subdecision signals.

* * * * *